United States Patent [19]

Simpson

[11] Patent Number: 4,581,850

[45] Date of Patent: Apr. 15, 1986

[54] COMBINATION PIVOT CORNER AND SLIDE GUIDE FOR SASH WINDOW

[75] Inventor: Harold Simpson, Hazelcrest, Ill.

[73] Assignee: Ashland Products Company, Chicago, Ill.

[21] Appl. No.: 627,989

[22] Filed: Jul. 5, 1984

[51] Int. Cl.[4] ..... E05D 15/22

[52] U.S. Cl. ..... 49/181; 49/446; 49/429; 49/438

[58] Field of Search ..... 49/181, 429–431, 49/437, 445, 446

[56] References Cited

U.S. PATENT DOCUMENTS

| | | | |
|---|---|---|---|
| 3,172,169 | 3/1965 | Anderson | 49/446 |
| 3,959,926 | 6/1976 | Noecker et al. | 49/181 |
| 4,144,674 | 3/1979 | Dovman | 49/181 X |
| 4,363,190 | 12/1982 | Anderson | 49/181 |
| 4,364,199 | 12/1982 | Johnson et al. | 49/181 |

*Primary Examiner*—Kenneth Downey

*Attorney, Agent, or Firm*—Silverman, Cass & Singer

[57] ABSTRACT

A unitary pivot corner member having a separate pivot pin for engaging the sash balance of a double-hung sash window assembly and a slide guide integral with the member for riding in a guide rail of the master frame jamb of the window assembly. A pair of the same members are installed at opposing bottom corners of a sash window. Each of the slide guides rides in a guide rail and functions to retain the engaged guide rail in square alignment relative to the sash window whereby to eliminate gapping between the sash window and master frame jamb as the sash window is slided.

7 Claims, 6 Drawing Figures

FIG. 1
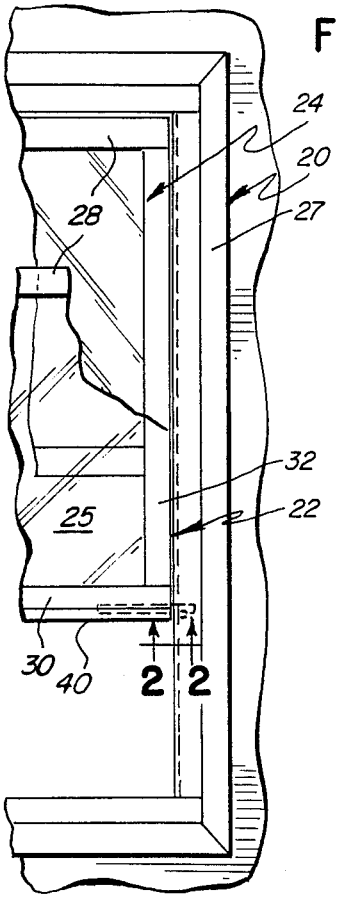
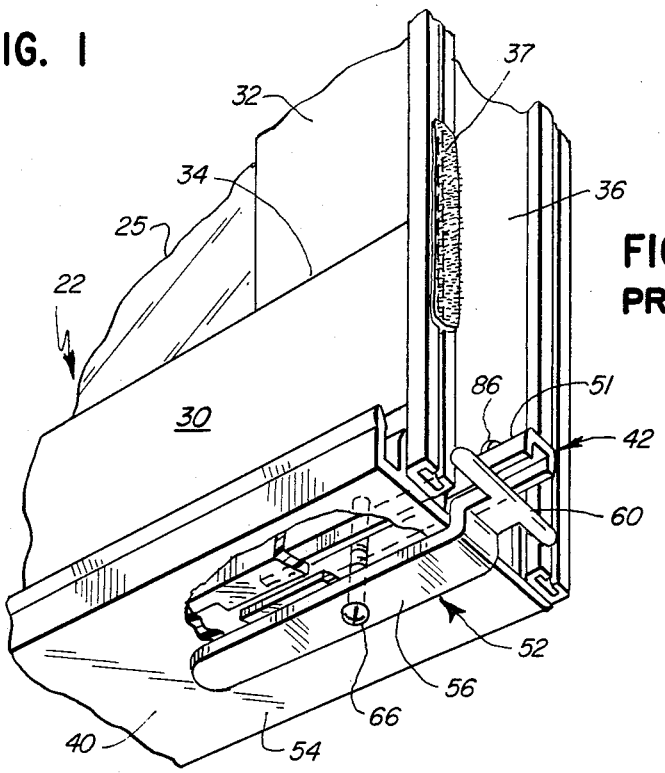
FIG. 3
PRIOR ART
FIG. 2
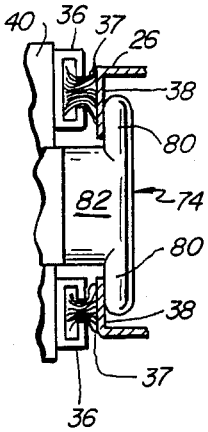
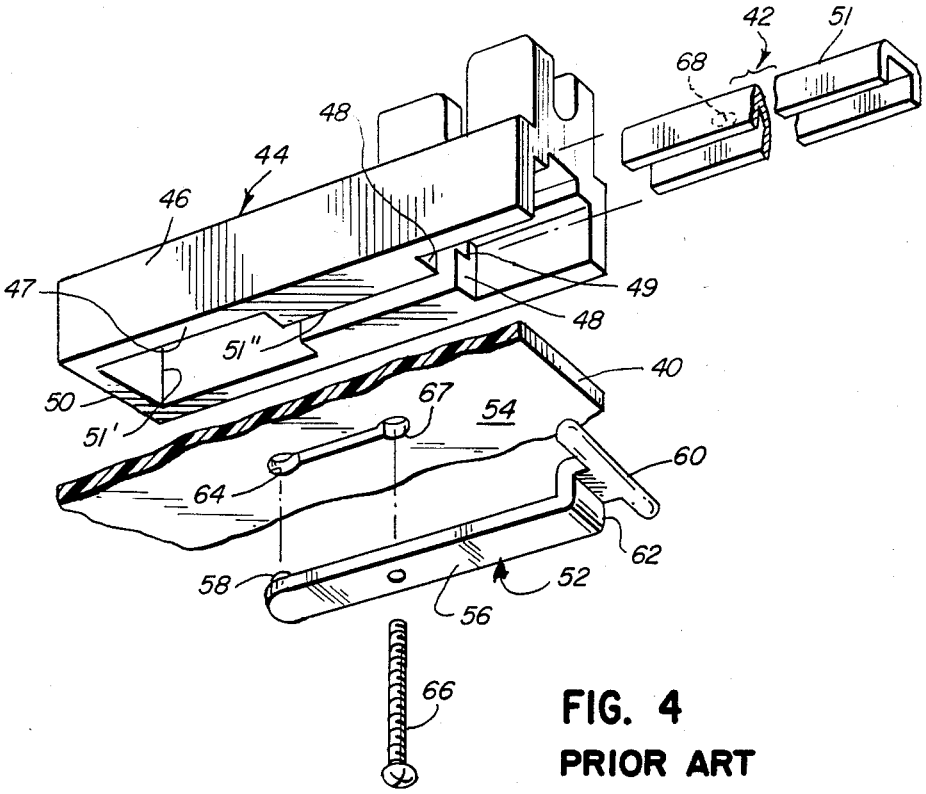
FIG. 4
PRIOR ART FIG. 5
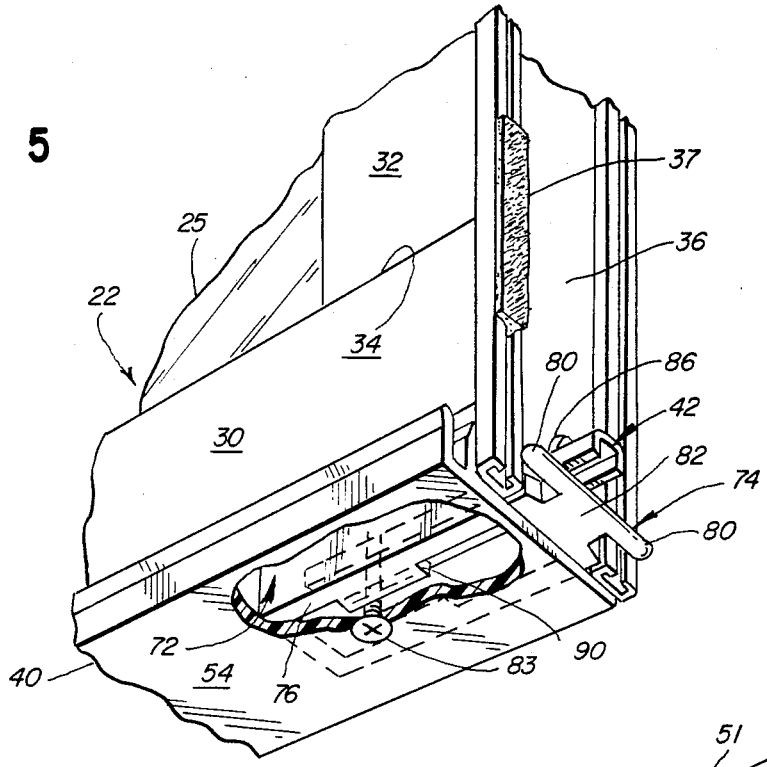
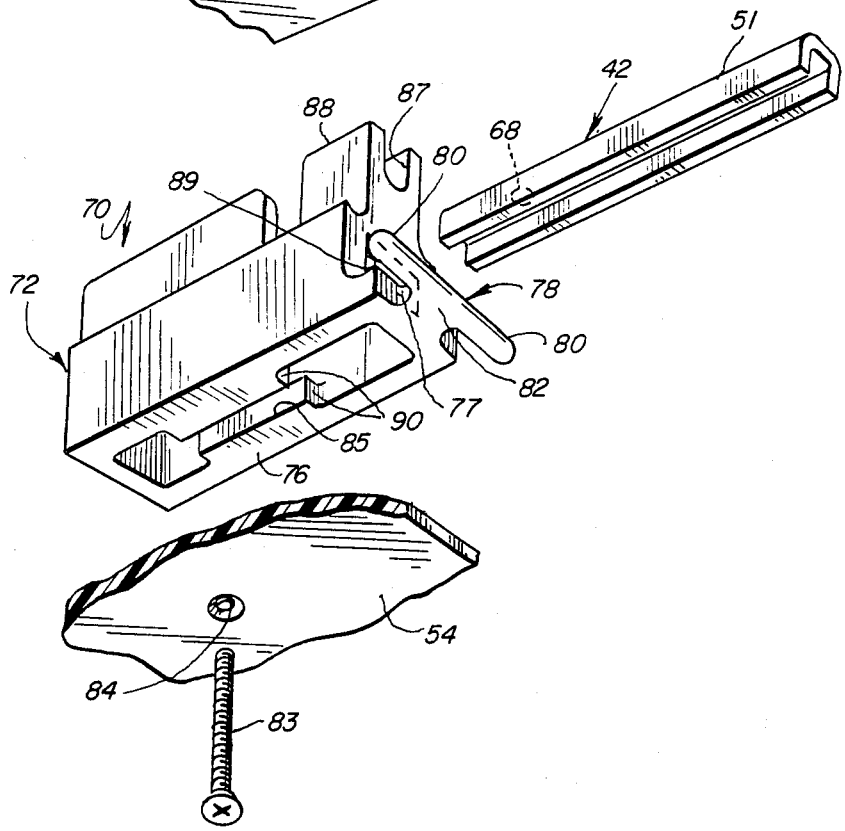
FIG. 6

COMBINATION PIVOT CORNER AND SLIDE GUIDE FOR SASH WINDOW

RELATED CASE REFERENCE

This application is related in the subject matter of the pivot means to applicant's co-pending patent application entitled Combination Locking and Associated Pivot Means for Extruded Plastic Sash Window Ser. No. 06/602,382, filed Apr. 20, 1984 and owned by the same assignee.

BACKGROUND OF THE INVENTION

This invention relates generally to the pivotal sash window of double-hung window assemblies and particularly, to a unitary, pivot corner and slide guide capable of being installed internally in the sash window frame with the said guide extending laterally outward of the proximate stile of the sash window frame for engaging the guide rail of the master frame jamb of the window assembly.

Double-hung window assemblies provide for selective pivoting of each window sash by means of a rotatable member at the bottom end of a sash balance mechanism located in the jamb of the master window frame. Each sash has a pivot pin extending outwardly from opposite sides of the sash frame for engaging the proximate sash balance for rotation of the sash around a lower pivotal axis. Normal vertical movement of the sash is restricted by a bolt protruding laterally from opposing upper ends of the sash engaging in guide rails in the master frame jambs. A suitable latch mechanism for the sash is disclosed in said related patent application.

The popular use of extruded synthetic plastic frame members assembled to form the sash and window assemblies is referenced in the related application also. An inventive feature of that related application is the internally installed support and connector member 82 which accommodates the pivot pin 216 engageable with the rotable member 34 of sash balance mechanism 20 for establishing a pivot axis around which the sash 18 can be pivoted or tilted inwardly. The pivot pin 216 is a strip of sheet metal of channel-shaped configuration of selected dimension to clear the jamb 24 when engaged with rotatable member 34.

In order to maintain the desired parallel relationship between the guide rails of the window frame jamb and the stiles or vertical frame members of the sash, recourse has been made to a separate metal member secured externally of the base member of the sash. This metal member included a T-shaped extension protruding beyond the sash frame stile to engage in the proximate guide rail and ride therein during raising and lowering of the sash. A pair of such metal members were mounted at lower bottom edges of the sash and gripped the guide rails so as to prevent their distorting or "bowing" during sliding of the sash. These metal members functioned as slide guides or restraining members to maintain the desired parallel relationship between the stiles of the sash frame and the guide rails of the master window frame jambs so the gaps therebetween would be eliminated.

These prior art metal slide guides were relatively expensive components of the sash window assembly since two such slide guides were required for each sash or four of them for each double-hung window assembly. Further, as separate members, their installation also involved a labor cost factor in their use in the industry.

SUMMARY OF INVENTION

A unitary molded member providing means for mounting a pivot pin for operative engagement with a sash balance mechanism and a slide guide means for operative engagement with the proximate guide rail of the jamb of a master window frame. The member is molded of a suitably strong synthetic plastic and constructed to be installed internally in the base member of the sash frame. As a unitary molded member, the prior art separate metal slide guide is eliminated with attendant substantial monetary savings for each sash. The molded member comprises a combination pivot corner and slide guide for a sash window of a double-hung window assembly useable with conventional master frame jambs.

DESCRIPTION OF DRAWINGS

FIG. 1 is a fragmentary front elevational view of a double-hung window assembly having the combination pivot corner and slide guide embodying the invention shown in broken outline installed in a sash window.

FIG. 2 is a fragmentary sectional view taken along the line 2—2 of FIG. 1 to illustrate the guide rail of the master frame jamb engaged by the slide guide part of the invention.

FIG. 3 is a fragmentary perspective view of a bottom corner of a sash window and broken away to illustrate installation of a prior art slide guide externally of the sash window frame.

FIG. 4 is an exploded perspective view of the installation in FIG. 3 depicting the separate metal slide guide of the prior art.

FIG. 5 is a fragmentary perspective view of a bottom corner of a sash window as depicted in FIG. 3 and broken away to illustrate installation of the combination pivot corner and slide guide embodying the invention.

FIG. 6 is an exploded perspective view of the combination member of FIG. 5 embodying the invention.

DESCRIPTION OF PREFERRED EMBODIMENT

FIG. 1 illustrates partially a representative window of the so-called double-hung window sash assembly. Such assembly includes a main jamb frame 20 within which is slidably mounted a pair of double-hung sashes 22 and 24 fitted with suitable glazing 25. Both the frame 20 and sashes 22 and 24 can be formed of several different materials, such as, metal or strong and rigid plastic materials well-known in this field. For purposes of this invention, the sashes 22 and 24 are pivotal relative to the frame 20 to permit cleaning and other required maintenance thereof.

The master frame 20 and sashes 22 and 24 are fabricated from elongate framing members preferably of hollow configuration in transverse cross-section for well-known reasons of economy, weight and thermal-insulation advantages. The exact construction of the master frame 20 is not critical for achieving the advantages of this invention. The vertical structural members of the master frame 20 will include sash balances designed to cooperate with pivot pins installed on the sashes 22 and 24 to permit desired pivotal movement of the sashes relative to the master frame. Further, these vertical structural members of the frame 20 will present guide rails facing on opposite sides of a contiguous sash with which a presented latch mechanism functions. A typical guide rail is designated 26 in FIG. 2 for the purpose of describing the invention. The guide rail 26 will be formed in a side jamb 27 of the master jamb frame seen in FIG. 1.

Referring to FIGS. 1 and 3, sash frame 22 is generally rectilinear in configuration and is comprised of a top header 28, a base 30 and pair of side members or stiles, one of which is illustrated at 32. The stiles or side members 32 are joined at their extremities to contiguous extremities of the header and base members, as seen generally at 34, to provide the sash frame of desired size and configuration. A track member 36 is secured to the exterior face of a stile 32 having slider pads 37 engaged against the juxtaposed segments or flanges 38 of the guide rail 26, seen in FIGS. 2 and 3. The jointed corners of the sash are maintained by suitable fasteners and brackets which can be well-known commercially available types. It will be appreciated that the upper sash 24 will be of like or similar construction. The base member 30 is enclosed by means of a closure channel member 40, best seen in FIG. 3, secured thereto. From the standpoint of the invention, base 30 is hollow, but its exact cross-sectional configuration can vary within wide limits. In this preferred embodiment, the sash 24, as is sash 22, is formed of extruded plastic frame members.

Referring to FIG. 3, to permit pivotal movement of sash 22, it was known to employ a pivot pin 42 of channel configuration installed at the bottom corner of sash 22. Pin 42 would protrude laterally outwardly of the stile 32 and track 36 through appropriate passages so that it could be engaged with a proximate sash balance. To hold and properly position the pin 42, it was known to employ a pivot corner member 44 of molded plastic. As seen in FIG. 4, corner member 44 has a body part 46 opening upwardly from the bottom end 47 and provided with a pair of spaced apart upstanding abutments 48, 48 medially thereof. The abutments 48, 48 were notched at 49 to provide ledges for accommodating the pin 42 thereon, as seen in FIG. 2. The rear wall 50 was located so as to assure proper pin position whereby a sufficient length of end portion 51 of the pin would protrude to engage a sash balance. The spaces 51' and 51'' between abutments 48, 48 extend upwardly through the entire body 46.

Again referring to FIGS. 2 and 3, in order to assure proper orientation of the track 36 relative to a guide rail 26 in the jamb 27, it was common to mount a separate slide guide member 52 to the underside wall 54 of closure member 40. The member 52 was formed of metal to provide a narrow strip segment 56 having a positioning lug 58 upstanding at one end thereof and a T-shaped restraining guide formation 60 offset upwardly from segment 56 by the connecting segment 62 normal to segment 56.

Referring to FIG. 3, pivot corner member 44 was located adjacent base member 30 with the pin 42 installed therein and segment 51 protruding. The closure member 40 was installed. The slide guide 52 was properly located against wall 54 by inserting lug 58 in the opening 64 provided in wall 54. To secure guide 52 in place, a threaded fastener 66 was engaged through opening 67 in wall 54 to pass between abutments 48, through opening 68 in pin 42, into the base member 30. Thus installed, the T-shpaed guide formation 60 was presented for engaging behind the segments 38 of a guide rail 26 when sash 22 was installed in the window jamb frame. Since such guide formations 60 were provided on opposite sides of a sash 22, they served to hold guide rails 26 in desired parallel relationship relative stiles 32 and tracks 36 during sliding movement of the sash. This operative relationship prevented gapping between the guide rails 26 and tracks 36.

Referring to FIGS. 5 and 6, the combination pivot corner and slide guide embodying the invention is designated generally by reference character 70. The combined member 70 is an integral member molded of a strong plastic material. Member 70 is comprised of a pivot corner part 72 and a slide guide part 74. The pivot corner part 72 is generally similar to the pivot corner member 44, albeit of a wider and sturdier formation, as readily seen from a comparison thereof in the drawings. However, the part 72 has a thick, planar, bottom wall 76 coextensive with the length of said part. Further, integral with wall 76 and extending laterally outwardly from the forward end 77 of body 72 is a sturdy, thick, T-shaped slide guide formation 74 having an enlarged head 78 comprising oppositely extending cross legs 80 separated from the proximate end 77 of body 72 by connecting segment 82.

The combination member 70 is shown installed in FIG. 2 with legs 80 of slide guide 74 engaging behind the segment or flanges 38 of a guide rail 26. Also shown installed in FIGS. 5 and 6 is member 70 and pivot pin 42 by means of a single bolt 83 extended through the single opening 84 in wall 54, into space 85 formed in bottom end 76, through the opening 68 into the base member 30. Member 70 was suitably open at its upper end to permit passage of fastener 83 into the base 30 for securing member 70 thereto. It will be noted that the additional fastener 86, only the head of which is visible in FIG. 5, is employed to pass through track 36, the clearance space 87 in the upstanding abutment 88 into a suitable interior wall provided in a sash frame member. This same additional fastening facility is provided in the installation of the corner member 44 and delineated by the same numeral characters, albeit with prime marks. Further noted in FIGS. 5 and 6 is pin 42 passed into passageway 89 in abutment 88 to seat on ledges provided at the upper ends of upstanding formations 90.

The integral molded comination member 70 eliminates the separate metal guide member 52 and its attendant separate installation requirement. As a single molded member 70, it is estimated that a savings of at least 41.00 per sash window has been realized.

Minor variations in size and configuration of parts will occur to the skilled artisan without departing from the thrust of the invention as recited in the appended claims.

I claim:

1. A combination corner pivot and slide guide member adapted to be installed inside the bottom corner of a window sash frame of a double-hung window assembly which provides a vertical jamb having a channel-shaped guide rail opening toward the vertical stile of the window sash frame, the channel-shaped guide rail having opposed inwardly directed flanges defining the opening therebetween, and a sash balance assembly within said guide rail, the vertical stile including a passage at the bottom corner aligned with the guide rail opening, said combination member comprising:

A. a unitary molded body having a bottom wall and a passageway through the wall opening toward the upper end of said body, and ledge formations spaced above said bottom wall;

B. said body having a lateral opening communicating with the ledge formations and located to receive a pin therethrough to be supported on said ledge formations with an extremity of the pin protruding from the body for extension through the stile passage, said pin being adapted for operative engagement with the sash balance assembly;

C. said body having an integrally molded slide guide formation protruding laterally outwardly substantially parallel with said bottom wall to underlie and generally parallel the protruding extremity of the pin for extension through said stile passage, said slide guide formation having an enlarged head on the outer end thereof adapted for engagement behind the guide rail flanges for engagement of said body with a guide rail when said combination member is installed for retaining the window sash and jamb in substantially parallel relationship during assembly and sliding movment of the window sash relative to the jamb, said slide guide formation, immediately inward of said enlarged head, comprising a pivot segment area adapted for reception and pivotal rotation between the guide rail flange when the enlarged head is engaged behind the guide rail flanges.

2. The combination member of claim 1 in which the enlarged head of said slide guide formation is substantially T-shaped.

3. The combination member of claim 2 in which the T-shaped enlarged head includes cross legs spaced outwardly of said lateral opening.

4. The combination member of claim 2 in which said passageway provides clearance adapted for reception of a threaded fastener passed therethrough into the base member of a sash frame with the combination member secured laterally in the base member.

5. The combination of claim 2 in which said body is molded of a synthetic plastic material.

6. The combination of claim 2 which includes an elongate pin of generally channel-shaped cross-section.

7. The combination of claim 1 wherein said guide formation is substantially coplanar with said bottom wall.

* * * * *

UNITED STATES PATENT AND TRADEMARK OFFICE

CERTIFICATE OF CORRECTION

PATENT NO. : 4,581,850

DATED : April 15, 1986

INVENTOR(S) : Harold Simpson

It is certified that error appears in the above-identified patent and that said Letters Patent is hereby corrected as shown below:

Column 3, line 64, delete "T-shpaed" and insert --T-shaped--;

Column 4, line 24, delete "segment" and insert --segments--;

Column 4, line 42, delete "comination" and insert --combination--;

Column 4, line 46, delete "41.00" and insert --$1.00--; and

Column 5, line 17, delete "movment" and insert --movement--.

Signed and Sealed this

*Eighth* Day of *July 1986*

[SEAL]

*Attest:*

*Attesting Officer*

DONALD J. QUIGG

*Commissioner of Patents and Trademarks*